US006125866A

United States Patent [19]

Nichols et al.

[11] Patent Number: 6,125,866

[45] Date of Patent: Oct. 3, 2000

[54] PUMP CLEANING UNIT FOR THE HEATER FIXTURE OF A SMOKING DEVICE

[75] Inventors: Walter Allen Nichols, Chesterfield; F. Murphy Sprinkel, Jr., Glen Allen, both of Va.

[73] Assignee: Philip Morris Incorporated, New York, N.Y.

[21] Appl. No.: 09/188,416

[22] Filed: Nov. 10, 1998

[51] Int. Cl.[7] ..... B08B 3/00

[52] U.S. Cl. ..... 134/196; 131/184.1; 131/243

[58] Field of Search ..... 131/243, 184.1, 131/184.3; 15/104.001; D32/1; 141/90; 239/106; 134/184, 196, 197, 117

[56] References Cited

U.S. PATENT DOCUMENTS

| | | | |
|---|---|---|---|
| 1,833,515 | 11/1931 | Budde | 134/196 |
| 5,388,594 | 2/1995 | Counts et al. | 131/329 |
| 5,505,214 | 4/1996 | Collins et al. | 131/194 |
| 5,530,225 | 6/1996 | Hajaligol | 219/535 |
| 5,591,368 | 1/1997 | Fleischhauer et al. | 219/535 |
| 5,839,457 | 11/1998 | Rijken et al. | 134/110 |

*Primary Examiner*—Stanley S. Silverman
*Assistant Examiner*—Robert McBride
*Attorney, Agent, or Firm*—Burns, Doane, Swecker & Mathis, LLP

[57] ABSTRACT

A pump cleaning unit for a heater fixture of a smoking device includes a base member. The base member includes a cup having an open end and a closed end, and a pedestal including a top part disposed in the cup proximate the open end of the cup and a leg connecting the top part to the closed end of the cup. A peripheral edge of the top part and an interior wall of the cup define a circumferential gap. The unit further includes a cylinder having a lower chamber and an upper chamber separated by a wall, a port extending through the wall. The cylinder has a cylinder wall proximate the lower chamber that fits in the circumferential gap and permits axial movement of the cylinder relative to the cup. A holder is provided for holding the heater fixture in the upper chamber over the port such that a central opening of the heater fixture is in flow communication with the port.

18 Claims, 4 Drawing Sheets

PUMP CLEANING UNIT FOR THE HEATER FIXTURE OF A SMOKING DEVICE

FIELD OF THE INVENTION

The invention relates to a cleaning unit for use with a component of a cigarette smoking system. More particularly, the invention relates to a cleaning unit which cleans the component via a pump-soaker apparatus.

BACKGROUND OF THE INVENTION

Commonly assigned U.S. Pat. Nos. 5,388,594; 5,505,214; 5,530,225; and 5,591,368 disclose various electrically powered smoking systems comprising electric lighters and cigarettes and are hereby expressly incorporated by reference. The systems provide smoking pleasure while significantly reducing side stream smoke and permitting the smoker to selectively suspend and reinitiate smoking. During operation of such smoking systems, condensate can collect on various parts of the heating fixture. In order to remove such condensates, the smoking device may include a heating component which is used to drive off such condensates. Even with such a heating component, it may not be possible to remove as much of the condensates as desired. Further, the smoking pleasure derived from the smoking system may be adversely affected by condensate build-up in areas which cannot be sufficiently heated to drive off the condensates.

Commonly assigned U.S. patent application Ser. No. 09/176,028 (Attorney Docket No. 021238-264) entitled, "Cleaning Unit for the Heater Fixture of a Smoking Device", inventors Joe Banyasz et al., filed Oct. 21, 1998, discloses several embodiments of cleaning units for spraying water on selected locations of a heater fixture to remove condensate, and is expressly incorporated by reference. A difficulty with these cleaning units is the need to have a sufficient supply of water, usually a conventional tap, to remove the condensate with running water over a period of time. These cleaning units are typically connected to the tap, and may not be able to be easily used if a standard tap is not available. It is desirable to provide a cleaning device that does not require a large amount of water to remove condensates from a heater fixture, and that need not be connected to a water supply tap.

SUMMARY OF THE INVENTION

According to one aspect of the present invention, a pump cleaning unit for a heater fixture of a smoking device is provided. The pump cleaning unit includes a base member. The base member includes a cup having an open end and a closed end, and a pedestal including a top part disposed in the cup proximate the open end of the cup and a leg connecting the top part to the closed end of the cup. A peripheral edge of the top part and an interior wall of the cup define a circumferential gap. The unit further includes a cylinder having a lower chamber and an upper chamber separated by a wall, a port extending through the wall. The cylinder has a cylinder wall proximate the lower chamber that fits in the circumferential gap and permits axial movement of the cylinder relative to the cup. A holder is provided for holding the heater fixture in the upper chamber over the port such that a central opening of the heater fixture is in flow communication with the port.

According to another aspect of the present invention, a method of cleaning a heater fixture of a smoking device is provided. According to the method, a cylinder of a cleaning unit, the cylinder having a lower chamber and an upper chamber separated by a wall, a port extending through the wall, is positioned in a base member of a cleaning unit, the base member including a cup having an open end and a closed end, and a pedestal including a top part disposed in the cup proximate the open end of the cup and a leg connecting the top part to the closed end of the cup, a peripheral edge of the top part and an interior wall of the cup defining a circumferential gap, the cylinder being positioned in the base member by axially moving a cylinder wall proximate the lower chamber into the circumferential gap. A heater fixture is held in the upper chamber over the port such that a central opening of the heater fixture is in flow communication with the port. An aqueous medium is filled into the cylinder such that at least a portion of the lower chamber above the top part of the pedestal is filled with the aqueous medium. The cylinder is moved downwardly into the cup such that the aqueous medium in the lower chamber above the top part of the pedestal is forced through the port and into the central opening of the heater fixture.

According to yet another aspect of the present invention, a method of cleaning a heater fixture of a smoking device is disclosed. According to the method, a heater fixture is soaked in an aqueous medium. At least selected portions of the heater fixture are sprayed with the aqueous medium.32.

According to yet another aspect of the present invention, a method of cleaning a heater fixture of a smoking article is disclosed. According to the method, a first chamber and a second chamber are communicated through a sprayhead. A heater fixture is soaked by positioning the heater fixture adjacent the sprayhead and filling at least portions of the first chamber and the second chamber with an aqueous medium. After the soaking step, the heater is impinged with the fluid by pumping the fluid from the first chamber through the sprayhead into the second chamber.

According to still another aspect of the present invention, a cleaning apparatus for a smoking article includes first and second mutually reciprocating elements, the elements being reciprocatable between a first position and a second position. The first and second elements at the first position define a first chamber and a second chamber, the reciprocable elements at the second position defining the second chamber, with the first chamber being displaced. The apparatus further includes a sprayhead adapted to effect fluid communication between the first chamber and the second chamber during reciprocation of the first and second elements. The apparatus further includes a holder adjacent the sprayhead for removably receiving a heater fixture. The first and second elements are mutually arranged for receipt of an aqueous medium when the first and second elements are at the first position such that the holder is at least partially immersed in the aqueous medium when the first and second elements are in an aqueous medium-retaining condition at the first position. The sprayhead is arranged to impinge preselected portions of the heater fixture with the aqueous medium as the sprayhead receives fluid from the first chamber as the first and second elements are reciprocated from the first position toward the second position.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION OF THE PREFERRED EMBODIMENTS

Figure 1:
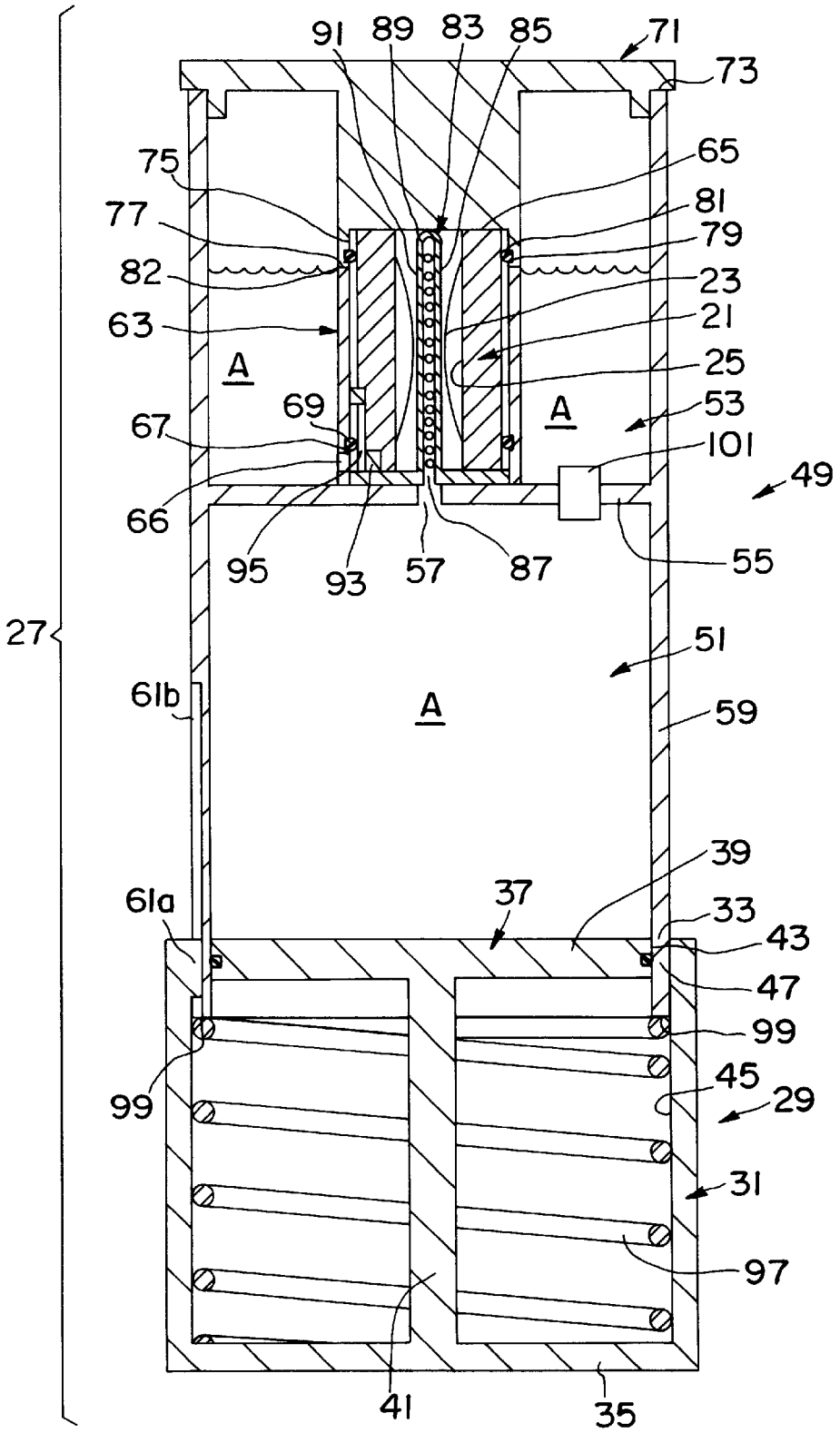
FIG. 1 is a schematic, cross-sectional side view of a pump cleaning unit according to an embodiment of the present invention, in a raised condition.
Figure 4:
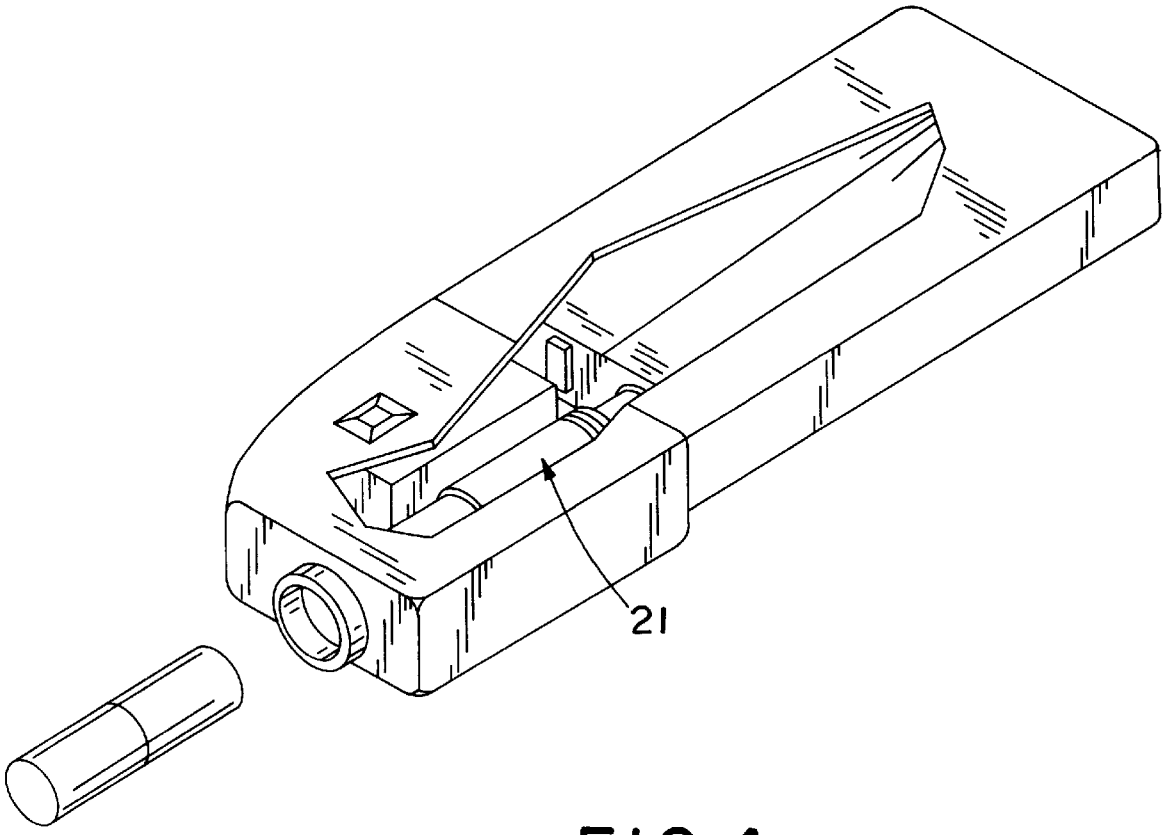
FIG. 4 is a schematic, perspective view of a smoking system according to an embodiment of the present invention.

U.S. Pat. Nos. 5,388,594; 5,505,214; 5,530,225; and 5,591,368 disclose various electrically powered smoking systems comprising electric lighters and cigarettes and are hereby expressly incorporated by reference. A smoking system representative of the type of smoking systems with which the present invention is usable is shown in FIG. 4. As seen in FIGS. 1 and 4, the electric lighters or heating fixtures of these smoking systems are typically tubular elements 21 with two open ends. As seen in FIG. 1, a plurality of mutually parallel, longitudinal heater blades 23 are arranged along an interior periphery of the tube and, in use, contact a specially adapted cigarette to heat the cigarette. The heater blades 23 are surrounded by a cylindrical can 25. During smoking, condensates can build up on the can 25 and the blades 23. Portions of the blades 23 are heated to very high temperatures so that some condensates adjacent the blades are sometimes charred. Condensates on the tips of the heater blades 23 are less easily removed. It has been determined that it is desirable to periodically clean the heater fixture to remove condensates from the heater blades 23, the can 25, and adjacent portions of the tube 21.

Figure 2:
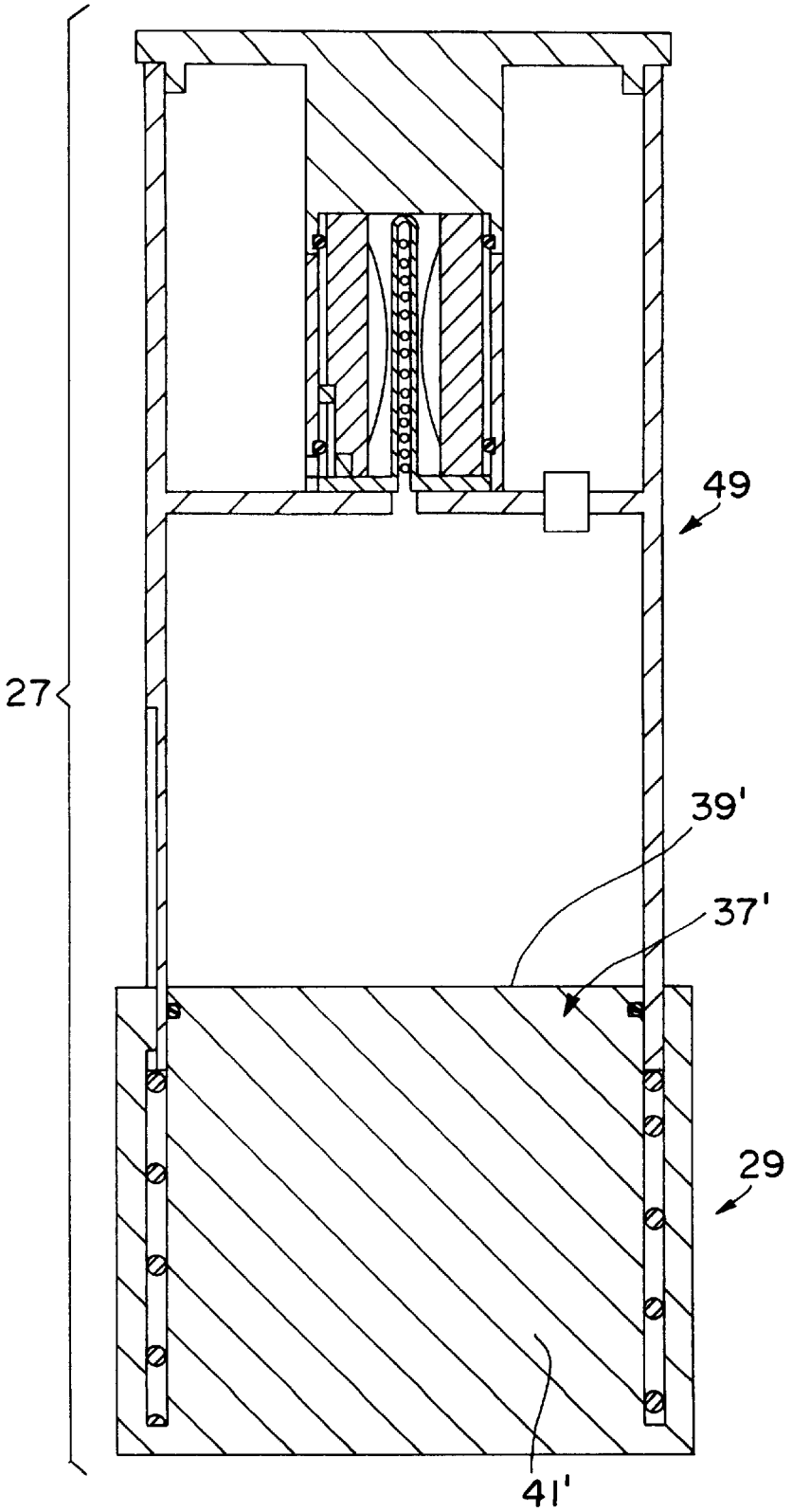
FIG. 2 is a schematic, cross-sectional side view of a pump cleaning unit according to a second embodiment of the present invention.

A cleaning unit 27 according to an embodiment of the present invention is shown in FIG. 1. The cleaning unit 27 includes a base member 29. The base member 29 includes a cup 31 having an open end 33 and a closed end 35, and a pedestal 37 including a top part 39 disposed in the cup proximate the open end of the cup and a leg 41 connecting the top part to the closed end of the cup. A peripheral edge 43 of the top part 39 and an interior wall 45 of the cup define a circumferential gap 47. An alternative embodiment of the pedestal 37' shown in FIG. 2 includes a leg 41' having the same size in a horizontal direction as the top part 39'. In either the embodiment of FIG. 1 or FIG. 2, the pedestal 37 and the base member 29 may be integrally formed, such as by a suitable plastic molding operation, or separate components that are attached during manufacture, such as by screwing the leg of the pedestal into a threaded opening in the base member or securing the leg to the base member by an adhesive.

The cleaning unit 27 further includes a cylinder 49 having a lower chamber 51 and an upper chamber 53 separated by a wall 55 or partition. A port 57 extends through the wall 55. The cylinder 49 has a cylinder wall 59 proximate the lower chamber 51 that fits in the circumferential gap 47 and permits axial movement of the cylinder relative to the cup 31. One or more suitable structures are provided for holding the heater fixture in the upper chamber 53 over the port 57 such that a central opening 63 of the heater fixture is in flow communication with the port.

The cylinder 49 and the cup 31 preferably include keying members for preventing rotational movement of the cylinder relative to the cup. The keying members may be in any suitable form, such as a projection and a corresponding projection receiving recess 61*a* and 61*b* on the cylinder and the cup, or on the cup and the cylinder, or the cup and the cylinder may both be non-circular such that they are able to move axially relative to each other, but not rotationally. Rotational movement of the heater fixture relative to the cylinder 49 is preferably also prevented, preferably by the one or more structures for holding the heater fixture in the upper chamber 53 over the port 57.

The structures for holding the heater fixture in the upper chamber 53 over the port 57 preferably include a holder cylinder 63 extending upwardly from the wall 55. The heater fixture is preferably received in the holder cylinder 63. The holder cylinder 63 preferably limits a level to which an aqueous medium A, such as water, to be used in cleaning the heater fixture can be filled, and preferably does not extend to a top 65 of the heater fixture as certain presently preferred embodiments of the heater fixture have small openings that can become clogged when water flows into the openings. The holder cylinder 63 preferably has one or more radial openings 66 to facilitate drainage of water from the upper chamber 53 to the lower chamber 51, and may include points at which it is not in close contact with the heater fixture to further facilitate drainage. The holder cylinder 63 preferably includes an O-ring groove 67 and an O-ring 69 for contacting the heater fixture at least at selected points to hold the heater fixture relative to the port 57.

Another structure for holding the heater fixture in the upper chamber 53 over the port 57 preferably includes a cap 71 adapted to be secured to a top end 73 of the cylinder 49, such as by internal or external threads (not shown) on the cap and external or internal threads (not shown) on the top end of the cylinder. The cap 71 preferably includes a recess 75 in a bottom surface 77 thereof in which the top end 65 of the heater fixture, including its small openings, is receivable. The recess 75 preferably includes an O-ring groove 79 and an O-ring 81 that is in contact with the entire periphery of the heater fixture proximate its top end 65 to prevent water from entering the small openings. A further port 82 is preferably defined by a gap between the bottom surface 77 and the top of the holder cylinder 63. The further port 82 and the openings 66 preferably facilitate admission of aqueous medium to the interior of the holder cylinder 63 to permit soaking of the heater fixture and drainage of water to the lower chamber 51.

In addition to, or instead of, one or both of the holder cylinder 63 and the cap 71, other suitable structures can be provided to hold the heater fixture relative to the port 57. One suitable structure may include one or more bendable prongs (not shown) for snapping around the top of the heater fixture and securing it in place. A spray head 83 is preferably provided in the upper chamber 53 over the port 57.

The spray head 83 preferably includes a tube 85 having an open end 87 disposed over the port 57 and a closed end 89, and a plurality of radial openings 91 in the tube. If desired or necessary, the spray head 83 can hold the heater fixture relative to the port 57, such as by providing the spray head with a retractable prong or prongs that can be snapped onto a suitable point on the heater fixture to hold it in place. The spray head 83 can be formed integrally with the cylinder 49, but is preferably a separate piece secured to the cylinder, such as by an adhesive.

A suitable spray head is disclosed in U.S. patent application Ser. No. 09/176,028 (Attorney Docket No. 021238-264), entitled "Cleaning Unit for the Heater Fixture of a Smoking Device", Inventors Joe Banyasz et al., filed Oct. 21, 1998, which is expressly incorporated by reference. As disclosed in U.S. patent application Ser. No. 09/176,028 (Attorney Docket No. 021238-264), it is desirable to maintain a particular rotational orientation between the spray head and the heater fixture so that jets of water from the spray head are directed between the blades 23 of the heater fixture and onto the surface of the can 25. Accordingly, the cylinder 49 preferably includes a key 93, the key corresponding with a corresponding key 95 on the heater fixture, for preventing rotational movement of the heater fixture relative to the spray head 83. The key 93 on the cylinder 49 may be on the holder cylinder 63, the spray head 83, or the wall 55, or any other suitable location as desired or necessary.

A spring 97 is preferably disposed in the cup 31 and is arranged to contact a bottom surface 99 of the cylinder wall 59. The bottom surface 99 of the cylinder wall 59 may be flanged to facilitate alignment between the spring 97 and the bottom surface. When, during operation, the cylinder 49 is pressed down into the cup 31, the spring 97 provides a force to thereafter urge the cylinder back to a raised position relative to the cup.

A one way valve 101 is preferably provided in the wall 55 of the cylinder 49 to facilitate filling the lower chamber 51 of the cylinder with water prior to operation. The valve 101 prevents water in the lower chamber 51 from entering the upper chamber 53 through the valve when, during operation, the cylinder 49 is pressed down into the cup 31. In this way, during operation, when the water in the lower chamber 51 is under pressure, the pressure can only be relieved by the water exiting the lower chamber 51 through the port 53, and then through the spray head 83 and against the locations of heater fixture that are desired to be cleaned.

A method of cleaning a heater fixture of a smoking device according to the present invention will be described with reference to FIGS. 1 and 3. As seen in FIG. 1, the cylinder 49 is positioned in the base member 29 by axially moving the cylinder wall 59 proximate the lower chamber 51 into the circumferential gap 47. The heater fixture is held in the upper chamber 53 over the port 57 such that a central opening of the heater fixture is in flow communication with the port.

An aqueous medium A, such as water, is filled into the cylinder 49 such that at least a portion of the lower chamber 51 above the top part 39 of the pedestal 37 is filled with the aqueous medium. The aqueous medium A is preferably filled such that at least a portion of the upper chamber 53 is filled with the aqueous medium to below a top 65 of the heater fixture.

Figure 3:
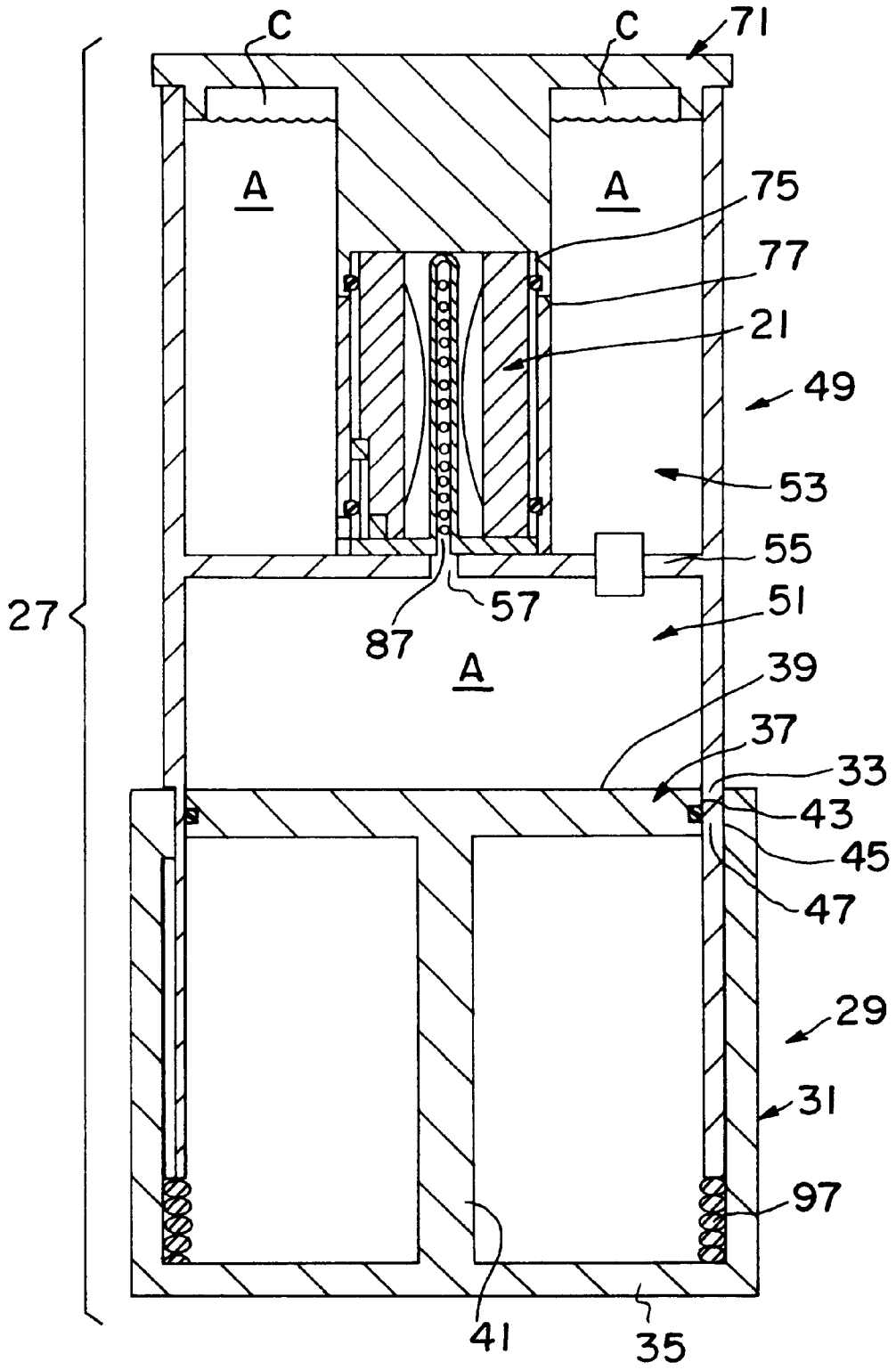
FIG. 3 is a schematic, cross-sectional side view of a pump cleaning unit of FIG. 1 is a compressed condition.

As seen in FIG. 3, the cylinder 49 is moved downwardly into the cup 31 such that the aqueous medium in the lower chamber 51 above the top part 39 of the pedestal 37 is forced through the port 57 and into the central opening of the heater fixture, preferably through the spray head 83. The spring 97 then urges the cylinder 49 back to a raised condition and water in the upper chamber 53 drains through the port 57 and through the one way valve 101, if provided, back to the lower chamber 51. Compressed air C in the upper chamber between the aqueous medium and the cap 71 preferably also aids in raising the cylinder 49 relative to the cup 31. If desired or necessary, the cylinder 49 can be raised relative to the cup 31 in a completely manual fashion, such as where no spring 97 or cap 71 is provided. The cycle is preferably repeated several times.

The inventors have learned that it is particularly advantageous to soak the heater fixture in the aqueous medium before moving the cylinder downwardly. The heater fixture is preferably soaked for about ten minutes, and the aqueous medium, upon being filled into the cylinder 49, is preferably about 100° F. to about 150° F., more preferably about 110° F. to about 130° F., and most preferably about 115° F. It may also be desirable to brush the heating fixture in the manner disclosed in commonly-assigned U.S. patent application Ser. No. 021238-271 (PM 1852) for "Brush Cleaning Unit for the Heater Fixture of a Smoking Device", inventors Grier Fleischauer et al., filed the same date as the present application, the disclosure of which is expressly incorporated by reference.

The pump cleaning unit according to the present invention has been found to be able to perform at least a comparable cleaning job as the cleaning unit according to U.S. patent application Ser. No. 09/176,028 (Attorney Docket No. 021238-264) that preferably uses a source of running water while using only a fraction of the water used in that cleaning unit. Moreover, the pump cleaning unit according to the present invention can be used in virtually any setting where water can be provided, regardless of whether the tap to be used is a standard size fitting.

The cap 71, or any other suitable part of the cleaning unit 27, can be provided with a fitting that is connectable to a tube (not shown) for draining the aqueous medium from the cleaning unit directly into a drain after use. A rotary valve can be provided for the fitting so that a small rotation of the cap opens the valve after use. The water may be expelled by compressing the cylinder 49 relative to the cup 31 to the convenience of the user.

While this invention has been illustrated and described in accordance with a preferred embodiment, it is recognized that variations and changes may be made therein without departing from the invention as set forth in the claims.

What is claimed is:

1. A pump cleaning unit for a heater fixture of a smoking device, comprising:

a base member, the base member including a cup having an open end and a closed end, and a pedestal including a top part disposed in the cup proximate the open end of the cup and a leg connecting the top part to the closed end of the cup, a peripheral edge of the top part and an interior wall of the cup defining a circumferential gap;

a cylinder having a lower chamber and an upper chamber separated by a wall, a port extending through the wall, the cylinder having a cylinder wall proximate the lower chamber that fits in the circumferential gap and permits axial movement of the cylinder relative to the cup;

a holder for holding a heater fixture in the upper chamber over the port such that a central opening of the heater fixture is in flow communication with the port.

2. The pump cleaning unit of claim 1, wherein the cylinder and the cup include keying members for preventing rotational movement of the cylinder relative to the base member.

3. The pump cleaning unit of claim 2, wherein the holder prevents rotational movement of the heater fixture relative to the cylinder.

4. The pump cleaning unit of claim 1, wherein the holder prevents rotational movement of the heater fixture relative to the cylinder.

5. The pump cleaning unit of claim 1, wherein the cylinder is non-circular.

6. The pump cleaning unit of claim 1, wherein the holder includes a holder cylinder extending upwardly from the wall.

7. The pump cleaning unit of claim 6, wherein the holder cylinder includes an O-ring groove and an O-ring.

8. The pump cleaning unit of claim 6, wherein the holder includes a cap adapted to be secured to a top end of the cylinder.

9. The pump cleaning unit of claim 8, wherein the cap includes a recess in a bottom surface thereof in which a top end of the heater fixture is receivable.

10. The pump cleaning unit of claim 9, wherein the recess includes an 0ring groove and an O-ring.

11. The pump cleaning unit of claim 6, wherein the holder extends upwardly from the wall to a height below a top end of the heater fixture.

12. The pump cleaning unit of claim 11, wherein the holder includes at least one radial opening.

13. The pump cleaning unit of claim 1, wherein the holder includes a cap adapted to be secured to a top end of the cylinder.

14. The pump cleaning unit of claim 13, wherein the cap includes a recess in a bottom surface thereof in which a top end of the heater fixture is receivable.

15. The pump cleaning unit of claim 14, wherein the recess includes an O-ring groove and an O-ring.

16. The pump cleaning unit of claim 1, wherein the cylinder includes a spray head mounted over the port, the spray head including a tube having an open end disposed over the port and a closed end, and a plurality of radial openings in the tube.

17. The pump cleaning unit of claim 16, wherein the cylinder includes a key, the key corresponding with a corresponding key on the heater fixture, for preventing rotational movement of the heater fixture relative to the spray head.

18. The pump cleaning unit of claim 1, further comprising a spring disposed in the cup and arranged to contact a bottom surface of the cylinder wall.

* * * * *